US005963775A

United States Patent [19]

Fang

[11] Patent Number: 5,963,775

[45] Date of Patent: Oct. 5, 1999

[54] PRESSURE MOLDED POWDER METAL MILLED TOOTH ROCK BIT CONE

[75] Inventor: Zhigang Fang, The Woodlands, Tex.

[73] Assignee: Smith International, Inc., Houston, Tex.

[21] Appl. No.: 08/930,000

[22] Filed: Sep. 15, 1997

Related U.S. Application Data

[63] Continuation of application No. 08/567,545, Dec. 5, 1995, abandoned.

[51] Int. Cl.[6] ..... B22F 3/10; E21B 9/36

[52] U.S. Cl. ..... 419/36; 419/9; 419/37; 419/31; 419/54; 419/29; 76/108.2; 76/108.4; 327/331; 327/374

[58] Field of Search ..... 419/36, 9, 37, 419/31, 54, 29; 76/108.2, 108.4; 327/331, 374

[56] References Cited

U.S. PATENT DOCUMENTS

| | | | |
|---|---|---|---|
| 3,696,875 | 10/1972 | Cartes | 175/329 |
| 3,888,662 | 6/1975 | Boeckeler | 75/203 X |
| 4,368,788 | 1/1983 | Drake | 175/374 |
| 4,372,404 | 2/1983 | Drake | 175/374 |
| 4,398,952 | 8/1983 | Drake | 419/18 |
| 4,554,130 | 11/1985 | Ecer | 419/8 |
| 4,588,608 | 5/1986 | Jackson et al. | 427/34 |
| 4,626,476 | 12/1986 | Londry et al. | 428/457 |
| 4,626,477 | 12/1986 | Jackson et al. | 428/457 |
| 4,630,692 | 12/1986 | Ecer | 175/330 |
| 4,765,950 | 8/1988 | Johnson | 419/2 X |
| 4,808,360 | 2/1989 | Natori et al. | 264/221 X |
| 4,884,477 | 12/1989 | Smith et al. | 76/108 A |
| 4,964,907 | 10/1990 | Kiyota et al. | 75/235 X |
| 5,028,367 | 7/1991 | Wei et al. | 264/63 X |
| 5,059,387 | 10/1991 | Brasel | 419/23 X |
| 5,059,388 | 10/1991 | Kihara et al. | 419/37 X |
| 5,152,642 | 10/1992 | Pitts et al. | 408/226 |
| 5,279,374 | 1/1994 | Sievers et al. | 175/374 |
| 5,281,260 | 1/1994 | Kumar et al. | 75/240 X |
| 5,338,508 | 8/1994 | Nitta et al. | 420/120 |
| 5,366,688 | 11/1994 | Terpstra et al. | 419/36 X |
| 5,380,476 | 1/1995 | Matsushita et al. | 264/63 X |

FOREIGN PATENT DOCUMENTS

| | | |
|---|---|---|
| 1137053 | 12/1968 | United Kingdom . |
| 2287959 | 4/1995 | United Kingdom . |

OTHER PUBLICATIONS

ASM Handbook, vol. 7, Powder Metallurgy, pp. 495–500, 1984.

German, *Powder Injection Molding,* Metal Powder Industries Federation, Princeton, New Jersey, pp. 16–19.

D.E. Pearce, M.S. Nixon, and L.J. Wercholuk, CADE/CADDC Spring Drilling Conference, Powder Metal Cutter (PMC™) Technology Demonstrates Proven Performance in 200mm Bits in Canada, Paper No. 95–304, Apr. 19–21, 1995.

Randall M. German, Powder Injection Molding, 1990.

*Primary Examiner*—Daniel J. Jenkins
*Attorney, Agent, or Firm*—Christie, Parker & Hale, LLP

[57] ABSTRACT

A milled tooth shaped rotary cone drill bit for drilling oil wells and the like manufactured using a powder metallurgy process in which an alloy powder is pressure molded into the desired bit shape, sintered, and precision machined.

26 Claims, 1 Drawing Sheet

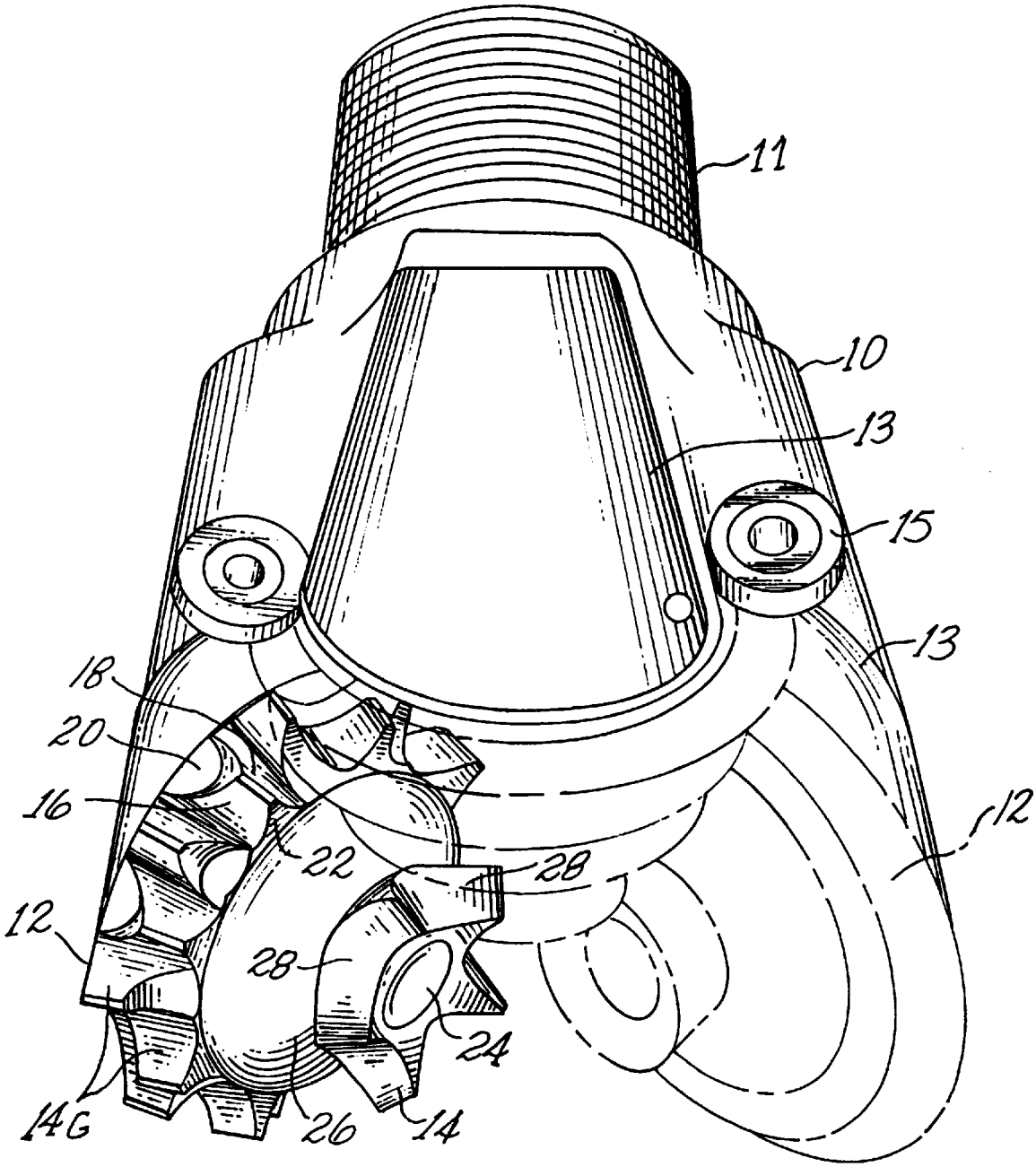
11
10
13
15
13
18
20
16
22
28
12
12
28
24
14G
26
14

PRESSURE MOLDED POWDER METAL MILLED TOOTH ROCK BIT CONE

CROSS-REFERENCE TO RELATED APPLICATION

This is a continuation of application Ser. No. 08/567,545, Dec. 5, 1995, now abandoned.

BACKGROUND OF THE INVENTION

This invention relates to "milled" tooth rotary cone rock bits and methods of manufacture therefor.

Rotary cone rock bit s for drilling oil wells and the like commonly have a steel body which is connected to the bottom of a long pipe which extends from the earth's surface down to the bottom of the well. The long pipe is commonly called a drill string. Steel cutter cones are mounted on the body for rotation and engagement with the bottom of the well being drilled to crush, gouge, and scrape rock thereby drilling the well. One important type of rock bit, referred to as a milled tooth bit, has roughly triangular teeth protruding from the surface of the cone for engaging the rock. The teeth are typically covered with a hard facing material harder than steel to increase the life of the cone. The teeth are formed into the steel cone by material-removal processes including turning, boring, and milling. Thus, the cone is referred to as a milled tooth rock bit cone because the teeth are manufactured by milling the teeth into a forged steel preform. The cones may also be referred to as steel tooth cones because they are predominantly manufactured from steel. A milled tooth rock bit cone can have 69 or more milled surfaces, five or more bores, and three or more turned surfaces. Thus, the production of a milled tooth rock bit cone is a labor intensive process, and a majority of the cost of a milled tooth rock bit cone is attributable to the labor cost. The cost is also increased by the waste of raw material which is machined away during the material removal process. The machining processes also leave sharp edges and corners on the finished cone. The sharp edges tend to crack, and the cracks propagate through the cone and through the hard facing, reducing the useful life of the cone. The sharp corners are plagued by stress concentrations which also promote cracking of the cone. Thus, teeth geometry must be limited to avoid sharp edges and corners. Further, the geometry of the teeth is limited by the capability of the milling process making infeasible some tooth shapes that increase the rate of penetration without breakage.

To address these limitations, some powder metallurgy techniques have been suggested to manufacture "milled" tooth rock bit cones. For instance, one process currently used utilizes a pattern to form a flexible mold which is filled with powdered metal. The mold is cold isostatically pressed to partially densify the powdered metal. Isostatic pressure is pressure equally applied on all sides of the mold. The partially densified part, called a green part or preform, is then heated and rapidly compressed to full density by a quasi-isostatic process.

To create the preform, the powdered metal, usually steel, is poured into the flexible mold while the mold is vibrated. Vibrating the mold during filling uniformly packs the powder in the flexible mold. The flexible mold is supported during the cold isostatic pressing by tooling which allows the deformation necessary to compress the pattern. After the mold is compressed, the preform is removed from the mold and subjected to uniform heating. Once the preform is heated, it is transferred to a central position in a cylindrical compression cavity in which it is surrounded by a bed of granular pressure transfer medium heated to approximately the same temperature as the preform. The pressure transfer medium is then axially compressed creating a quasi-isostatic pressure field acting on all surfaces of the preform. The radial pressure acting on the preform approaches a theoretical maximum of one-half of the axial pressure acting on the preform. After compression, the part is removed from the cavity and allowed to cool slowly over a two (2) hour time period. This powder metallurgy process requires two compression steps, and because the non-isostatic compression step causes a non-uniform reduction in size of the preform, its pattern is complex. The second compression process is essentially a hot pressing process, which is expensive and inefficient but only one part can be made at a time. Further, the steps required to prepare the part for the hot pressing process are complex and time consuming. Then, the process is not economical.

Other powder metallurgy process including powder injection molding have been utilized to fabricate small parts. In summary, this process begins by pelletizing or granulating a mix of powder metal and binder before injecting the pellets or granules into the mold. The mold is then removed, and the part is debinded and sintered. This process has only been utilized for small parts with thin cross-sections and heretofore has not been utilized for the production of milled tooth rock bit cones.

Thus, reduction in the required labor to fabricate a "milled" tooth rock bit cone is desirable to enhance the production rate and reduce production cost of the milled tooth rock bit cone. It is also desirable to diversify the geometric shapes of the teeth to increase the rate of penetration without the need for complexly shaped molds and preforms. Thus, the successful application of powder injection molding to produce "milled tooth rock bit cones" is desirable to bring about such an increase in the rate of penetration and decrease in the cost of rock bits which translates directly into reduction of drilling expense.

BRIEF SUMMARY OF THE INVENTION

There is, therefore, provided in practice of this invention a novel method for manufacturing a toothed rotary cone rock drill bit. The method comprises the steps of pressure molding a blend of a binder with an alloy powder into a mold defining toothed rotary cone shape thereby molding the blend into a toothed rotary cone shaped green part. In addition, the toothed rotary cone shape may contain an internal bearing surface which is machined to obtain the required tolerances for the bearing surface. Further, the blend may be subjected to preheating to facilitate filling the mold and to help the green part hold the desired shape until it is finally heated. In a preferred embodiment, the mold is made from water soluble material or other solvent soluble polymers. The mold is therefore consumable. To further increase the likelihood of the green part holding the desired shape until it is heated, the alloy powder may be presintered.

In a preferred embodiment, the green part is subjected to a thermal debinding process in which the green part is slowly heated to 100° F. and held at that temperature for one (1) hour. The green part is then heated to approximately 300° F. and held at that temperature from eight (8) to ten (10) hours, and then the green part is heated to 400° F. and held there for four (4) to eight (8) hours.

The invention is further directed to a toothed rotary cone rock drill bit manufactured by blending an alloy powder with a binder, pressure molding the alloy powder and the binder into the desired rock bit cone shaped green part, sintering/heating the green part, and machining the internal bearing surfaces. The rock bit cone is designed so that after sintering, the outer surface is the final net size, but the inner surface has extra material which allows precision machining of the inner surface to net size and shape.

BRIEF DESCRIPTION OF THE DRAWINGS

These and other features and advantages of the present invention will be appreciated as the same becomes better understood by reference to the following Detailed Description when considered in connection with the accompanying drawing in which similar reference characters denote similar elements and wherein:

FIG. 1 is a prospective view of a milled tooth rock bit cone formed by the powder metallurgy process of the present invention.

DETAILED DESCRIPTION

An exemplary milled tooth rock bit according to the present invention, shown in FIG. 1, comprises a stout steel body 10 having a threaded pin 11 at one end for connection to a conventional drill string (not shown). At the opposite end of the body, there are three rock bit cutter cones 12 for drilling rock for forming an oil well or the like. Each of the cutter cones is rotatably mounted on a pin (hidden) extending diagonally inward on one of the three legs 13 extending downwardly from the body of the rock bit. As the rock bit is rotated by the drill string to which it is attached, the cutter cones effectively roll on the bottom of the hole being drilled. The cones are shaped and mounted so that as they roll, teeth 14 on the cones gouge, chip, crush, break and/or erode at the rock at the bottom of the hole. The teeth 14G in the row around the heel of the cone are referred to as the gage row teeth. They engage the bottom of the hole being drilled near its perimeter on "gage." Fluid nozzles 15 direct drilling mud into the hole to carry away the particles of rock created by the drilling.

Such a rock bit is conventional and merely typical of various arrangements that may be employed in a rock bit. For example, most rock bits are of the three cone variety illustrated. However, 1, 2, and 4 cone bits are also known. The arrangement of teeth on the cones is just one of many possible variations. In fact, it is typical that the teeth on the three cones in a rock bit differ from each other, so that different portions of the bottom of the hole are engaged by the three cutter cones; and collectively, the entire bottom of the hole is drilled. A broad variety of tooth and cone geometries some of which are known can be fabricated utilizing the present invention, and these different tooth and cone geometries need not be further described for an understanding of the invention.

However, a short explanation of how the shape of the bit in FIG. 1 would be obtained using material removal processes is helpful. Each tooth would have four milled surfaces 16, 18, 20, and 22. The milled tooth rock bit cone would typically have three turned surfaces 24, 26, and the internal surface of the cone (not shown). Bores 28 would also be utilized in certain locations to aid in the material removal process. To avoid these labor intensive processes, powder metallurgy can be used to manufacture the cone.

Broadly, powder metallurgy is a class of processes whereby alloy powders comprising metals, ceramics, and other materials are molded into objects by compacting them in suitable dies and subsequently heating or sintering them at elevated temperatures to obtain the required density and strength. Alloy or metal powders are produced by many processes, including atomization, reduction, electrolytic deposition, thermal decomposition of carbonyl, mechanical comminution, precipitation from a chemical solution, production of fine chips by machining, and vapor condensation. Because the powders formed by the processes mentioned above have different sizes and shapes, it is necessary to blend them to obtain uniformity. During the blending phase, special physical and mechanical properties may be imparted to the toothed rotary rock bit cone by blending different metallic powders or other materials into the alloy powder. The blended alloy powder is then formed into the desired toothed rotary cone shape in dies or molds using hydraulically or mechanically actuated presses. The compaction obtains the required shape, density, and particle contact to impart sufficient strength to the part to enable handling for further processing.

The preferred embodiment shown utilizes a steel powdered metal blended with a thermoplastic binder which is injection molded to form a green part having the desired cone geometry and larger than net size. The green part is then subjected to a debinding process at a temperature range between 100° F. and 400° F. inclusive. The green part is then sintered at temperatures from 800° C. to 1300° C. inclusive depending on the materials used to fabricate the cone. The outer surface including the teeth 14, is the final net shape after the sintering process. The internal surfaces of the rotary cone are designed to be near net shape after the sintering process. Specifically, the internal bearing surfaces are designed to have extra material after the sintering process, so that the bearing surfaces can be precision machined to the proper dimensions. This is required because the bearing surfaces require low tolerances. The cone can be heat treated to obtain the required ductility, hardness, and strength properties, and a hard facing material can be placed on the teeth. Though the preferred embodiment shown utilizing the present invention is a milled toothed shaped cone, the invention can easily be applied to manufacture a bit or cone shaped to receive inserts.

In detail, a preferred embodiment of the molding process includes pressure molding the blended alloy powder into a die or mold with an auger or press to obtain the necessary strength to enable further processing. The pressure molding is conducted at less than approximately 100 psi. It is preferable to pull a vacuum in the mold before filling the mold with the powder metal. When a vacuum is pulled in the mold the pressure is approximately 1 atmosphere or 14.5 psi. To further increase the part's ability to maintain its shape during processing, the powder metal is blended with a thermoplastic binder before forming the powder into the desired shape. During pressure molding of a powder metal blended with a thermoplastic binder, the blend is heated to a temperature not high enough to melt the binder, but high enough to facilitate the flow of the blend into the mold. The temperature range is typically from 100° F. to 150° F. Thus, the binder also acts as a lubricant during pressure molding to enable the blend to flow into the mold like a liquid, obtaining a more densified compact. The preferred plastic binder contains wax, kerosine, and a surfactant, usually duamine. The amount of plastic binder can be as great as fifty percent (50%) by volume. However, the usual range is from fifteen percent (15%) to forty percent (40%) by volume. Other binders include polyethylene and acetal resins. Water soluble materials such as polyvinyl alcohol can also be utilized as the binder.

The blend is then allowed to cool in the mold before the mold is removed. Preferably, the mold is a consumable, one-time use water soluble mold which dissolves in water. In a referred embodiment, the mold is made of polyvinyl alcohol, which is water soluble. For several reasons, the use of a consumable mold is advantageous over the use of a steel mold, which is used repeatedly. First rock bit designs change rapidly; so the useful life of the expensive steel mold is not fully utilized. Thus, the consumable mold allows greater versatility of rock bit designs, and further the complex rock bit slopes are more easily removed from consumable molds. The consumable mold is simply dissolved without placing any appreciable force on the part. With a steel mold, however, the multiple parts of the steel mold must be pulled apart. Pulling the mold pieces apart can put stress on the teeth or other protrusions of the part.

After removing or dissolving the consumable mold, the cone produced by the molding process, commonly referred to as a green part, is thermally debinded. If the water soluble binder is used, the green part is debinded with water. Because of the large size of the cone and the thick cross sections of the cone, the thermal debinding process is more involved than for previous pressure molding processes. The green part is debinded from eight (8) to twenty-four (24) hours. Preferably, the green part is slowly heated to a first temperature of 100° F. for one (1) hour. Then it is slowly heated to a second temperature of 300° F. and held there for eight (8) to ten (10) hours, and then it is heated further to a third temperature of 400° F. and held there for another four (4) to eight (8) hours.

After debinding, both the inner and outer surfaces of the cone are larger than net size. To bring the cone to full density and net size, the green part is subjected to heat in a controlled atmosphere furnace at a temperature typically just below the melting point of the alloy powder and sufficiently high to allow the bonding of the individual particles. This process, referred to as sintering, is performed at a temperature range of 800° C. to 1300° C. depending on the materials used in the cone. Because the green part is quite weak and has a low strength, the green part may be pre-sintered by heating it to a temperature lower than the normal temperature for final sintering.

Sintering can be conducted in the solid phase, liquid phase, or supersolidus liquid phase, depending on alloys used. When liquid phase sintering is used with steel powder, the powder metal is alloyed with copper or boron. Both boron and copper create a liquid between solid iron molecules at lower temperatures, but the copper results in actual liquid phase sintering. Copper and its alloys can also be used in an infiltration process to eliminate porosity in the cone. Further, a conventional hot isostatic pressing step might be necessary to achieve 100% density for some alloys.

After sintering, the outer surface of the cone is net size and shape, but parts of the inner surface of the cone have excess material that is machined away to create the internal bearing surfaces. Additional processes, such as heat treating and hard facing, can be performed on the cone as required by the intended use for the cone.

Utilizing the present invention, significant machining costs are avoided, and the configuration of the teeth is no longer limited by the capability of material removal operations. Sharp edges and corners are largely eliminated, and tooth shapes impossible to obtain through material removal processes can be obtained with powder metallurgy. Rock bit cones manufactured according to the present invention can utilize tooth configurations which increase the rate of penetration and tooth shapes which facilitate hard facing of the teeth, thereby increasing the life of the cone. Further, there is a reduction in the use of raw materials because far less of the original cone is machined away.

Thus, a toothed rotary cone rock drill bit is disclosed which utilizes pressure molding to more efficiently obtain the desired bit designs and to create bit designs which were before infeasible. While embodiments and applications of this invention have been shown and described, it would be apparent to those skilled in the art that many more modifications are possible without departing from the inventive concepts herein. It is, therefore, to be understood that within the scope of the appended claims, this invention may be practiced otherwise than as specifically described.

What is claimed is:

1. A method of manufacturing a milled tooth rotary rock bit cone comprising:

pulling a vacuum in a mold defining a milled tooth rotary cone shape having a plurality of teeth;

injection molding at a pressure less than 100 psi a blend of an alloy powder and a binder into the mold to form a toothed rotary cone shaped green part having a plurality of teeth, said toothed cone green part being complementary to the mold; and heating the green part.

2. The method of claim 1 further comprising:

preparing an alloy powder;

blending the alloy powder with a binder; and pelletizing the blend.

3. The method of claim 1 wherein the mold is consumable, and further comprising removing the green part from the mold.

4. The method of claim 3 wherein the consumable mold is dissolved.

5. The method of claim 1 further comprising debinding the green part.

6. The method of claim 5 wherein the green part is debinded with water.

7. The method of claim 1 wherein the mold comprises a consumable mold.

8. The method of claim 5 where in the green part is thermally debinded.

9. The method of claim 8 wherein the thermal debinding comprises:

slowly raising the green part to a first temperature, and holding it at the first temperature for a first period of time;

slowly raising the temperature of the green part to a second temperature, and holding it at the second temperature for a second period of time; and slowly raising the temperature of the green part to a third temperature and holding it at the third temperature for a third period of time.

10. The method of claim 9 wherein the first temperature is approximately 100° F., the second temperature is approximately 300° F., and the third temperature is approximately 400° F.

11. The method of claim 9 wherein the first time period is approximately 1 hour, the second time period is from approximately 8 hours to approximately 10 hours, and the third time period is from approximately 4 hours to approximately 8 hours.

12. The method of claim 1 further comprising:

injection molding the blend into a toothed rotary cone shape having at least one internal bearing surface; and machining at least one internal bearing surface.

13. The method of claim 1 further comprising heat treating the green part after heating.

14. The method of claim 1 further comprising bonding a hardfacing material onto the teeth.

15. The method of claim 1 wherein the alloy powder is a steel powder.

16. The method of claim 1 wherein the binder is a thermoplastic binder.

17. The method of claim 1 further comprising heating the blend to between approximately 100° F. and approximately 150° F.

18. The method of claim 1 further comprising the step of pre-sintering the alloy powder.

19. A method of manufacturing a milled tooth rotary cone rock bit comprising the steps of:

fabricating a mold defining a milled tooth rotary cone shape having a plurality of teeth and at least one internal bearing surface;

preparing an alloy powder;

blending the alloy powder with a binder;

injection molding the alloy powder and the binder into the mold at a pressure of less than 100 psi to form a toothed rotary cone shaped green part;

removing the green part from the mold;

thermally debinding the green part for at least 12 hours at temperature range from approximately 100° F. to approximately 400° F.;

sintering the alloy powder; and machining the internal bearing surface.

20. The method of claim 19 further comprising heating the blend of the alloy powder and binder before injection molding.

21. A milled tooth rotary cone rock drill bit comprising a body including a plurality of teeth and at least one internal bearing surface, the body being formed by preparing an alloy powder, blending the alloy powder with a binder, injection molding the alloy powder and the binder into a mold, at a pressure less than 100 psi, sintering the blend and machining the bearing surface.

22. The toothed rotary cone drill bit of claim 21 wherein the body is further formed by pre-sintering the alloy powder.

23. The bit of claim 22 wherein the green part comprises an outer surface and an inner surface and the green part is formed by injection molding the outer surface and the inner surface to larger than net size, sintering the green part such that the outer surface is net size and the inner surface is at least in part larger than net size, and machining at least part of the inner surface to net size.

24. The bit of claim 22 wherein the body is further formed by heating the blend of alloy powder and binder.

25. A milled toothed rotary cone rock drill bit formed by the process of claim 1.

26. A milled toothed rotary cone rock drill bit formed by the process of claim 19.

* * * * *